United States Patent [19]

Masuda

[11] Patent Number: 4,545,897

[45] Date of Patent: Oct. 8, 1985

[54] CLASSIFIER

[75] Inventor: Hiroaki Masuda, Hiroshimaken, Japan

[73] Assignee: Sankyo Dengyo Co., Ltd., Japan

[21] Appl. No.: 521,569

[22] Filed: Aug. 9, 1983

[30] Foreign Application Priority Data

Aug. 9, 1982 [JP] Japan ..... 57-138122

[51] Int. Cl.[4] ..... B07B 7/04

[52] U.S. Cl. ..... 209/135; 209/143

[58] Field of Search ..... 209/135, 143, 138, 139 R; 239/310, 318; 55/17

[56] References Cited

U.S. PATENT DOCUMENTS 3,288,285 11/1966 Walker et al. ..... 209/143
3,509,932 5/1970 Chambers ..... 55/17 X
3,859,205 1/1975 Reba et al. ..... 209/143 X
3,981,798 8/1975 Peterson ..... 209/143
4,301,002 11/1981 Loo ..... 209/143

FOREIGN PATENT DOCUMENTS 0076092 6/1979 Japan .

*Primary Examiner*—Charles Hart
*Attorney, Agent, or Firm*—Steinberg & Raskin

[57] ABSTRACT

A classifier for particles includes a nozzle substantially in the shape of a rectangle in cross-section, through which a gas stream carrying particles to be separated flows. Finer particles exit through a slit in one side of the substantially rectangular nozzle. In alternative embodiments, more than one such slit may be provided in the nozzle, and/or the nozzle may be substantially angularly-shaped in cross-section.

15 Claims, 10 Drawing Figures

FIG. 2a
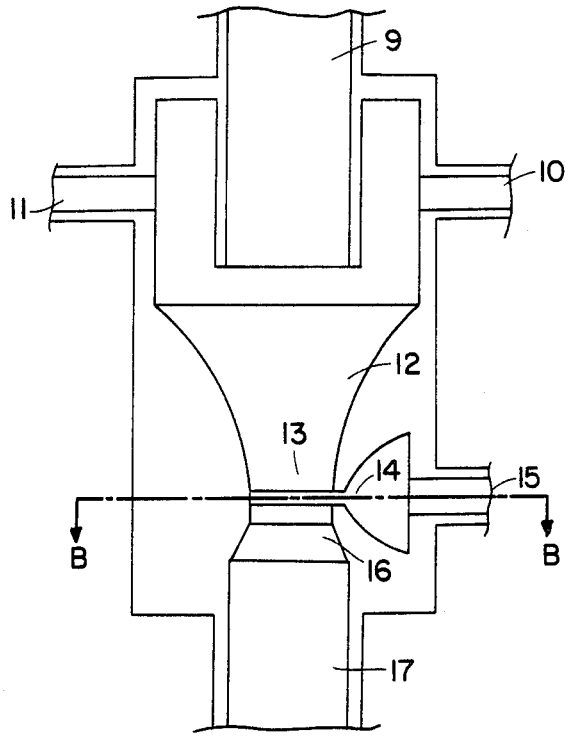
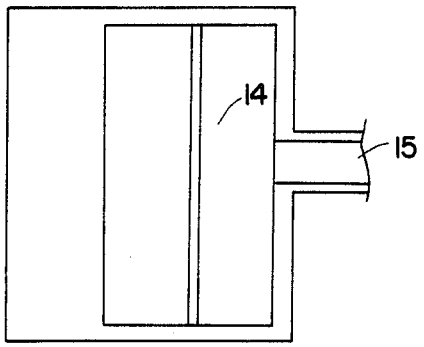
FIG. 2b

FIG. 3a
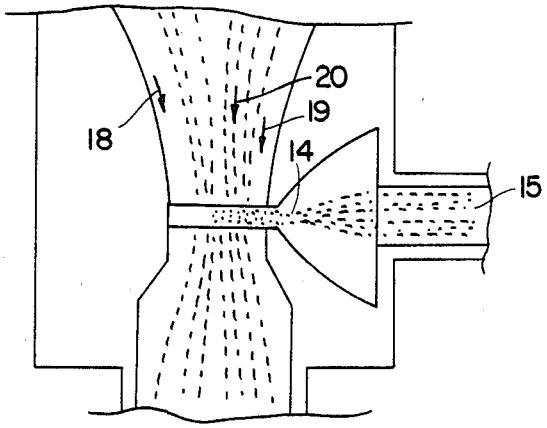
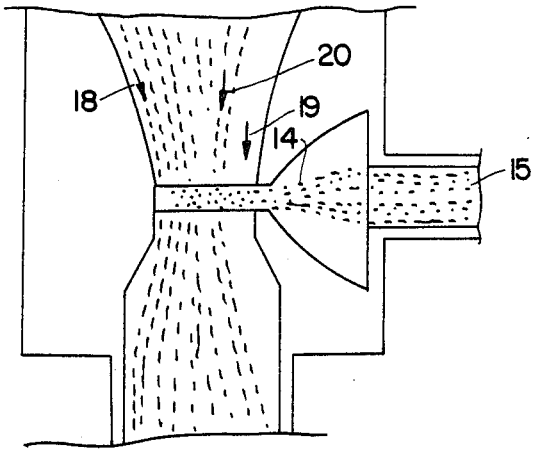
FIG. 3b

FIG. 4a
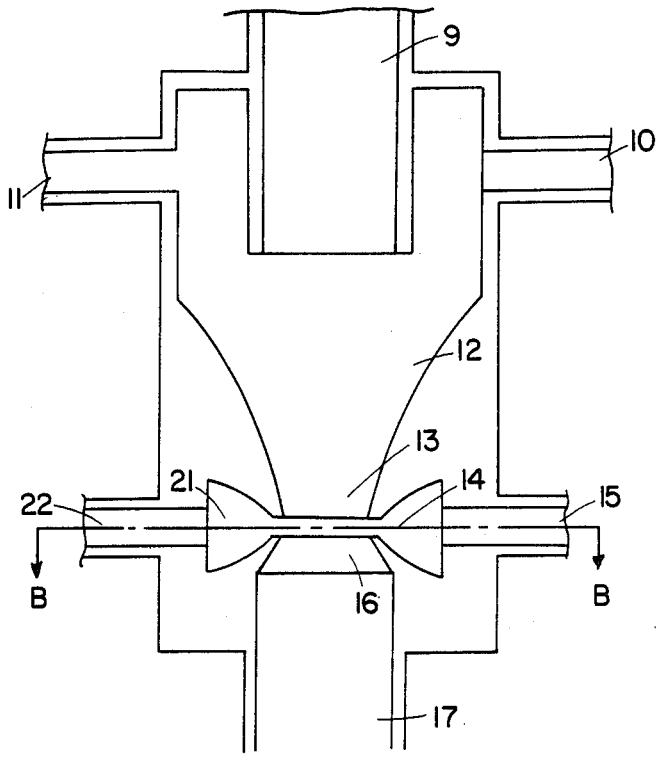
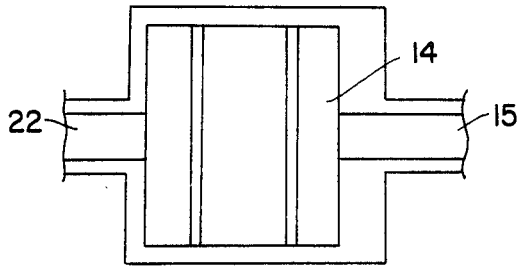
FIG. 4b

CLASSIFIER

BACKGROUND OF THE INVENTION

The present invention relates to a classifier for separating particulate matter according to size.

Classifiers are known in which net or centrifugal force is used to classify or separate particles according to size. However, such classifiers are not entirely suitable for classifying fine powders. A classifier for classifying or separating fine particulate matter such as ceramic powder is disclosed in Japanese Application No. 54-076092. The operation of this classifier is illustrated in FIG. 1 herein. Two clean (particle-free) air flows surround a gas flow which contains particles to be separated or classified by the so-called impact phenomenon. As illustrated in FIG. 1, the gas stream containing the particles flows into the classifier through inlet 1, while the two clean air streams flow into the classifier through inlets 2 and 3 resulting in a three-phase stream of circular cross-section within the classifier. This three-phase flowing stream reaches nozzle 4 which has a circular cross-section, where finer particles are separated from coarser particles and flow out with fluid passing through circular slit 5 extending around the nozzle 4 and through outlet 8. The coarser particles flow through nozzle 6 and out through outlet 7. In this instance, classification of particles is extremely sharp, i.e. there are relatively few of the coarser particles entrained with the finer particles. Therefore, the classifier of Japanese Application No. 54-076092 is suitable for fine powder classification. However, this prior art classifier is not desirable from the standpoint of energy efficiency, because the overall quantity of production is relatively low while a great deal of gas is used for classification purposes.

SUMMARY OF THE INVENTION

Accordingly, it is an object of the present invention to provide a new, improved method and apparatus for sharp classification of particles, especially of fine powders.

It is also an object of the present invention to provide a new and improved method and apparatus for maximum energy efficiency in the classification of particles.

It is a further object of the present invention to provide a new, improved apparatus and method for feasible adjustment of classification size of such particles being classified.

It it is a still further object of the present invention to provide for simple manufacture of an apparatus for classifying particles.

These and other objects of the present invention will become apparent in the following description of the present invention.

Briefly, in accordance with the present invention, these and other objects are attained by providing a classifier for particles which comprises a nozzle of substantially rectangular cross-section through which a gas stream carrying particles to be separated flows, with the nozzle provided with an opening, such as a narrow slit, along one side thereof. Through inpact phenomenon occurring within the nozzle, particles are separated or classified, with finer particles passing out through the slit along with gas flowing through the slit, while the coarser particles remain entrained in the main gas stream flowing through the nozzle. The classifier of the present invention is specifically designed to accommodate three-phase gas flow, for example, flow comprising a gas stream containing particles to be classified, and comprising two "clean" gas streams that are substantially particle-free. Moreover, the separation size or classification demarcation of particles can be sharply and conveniently set and adjusted in the classifier of the present invention, by simply altering the flow rates of the individual gas streams in the multi-phase flow. The present invention is also directed to several other embodiments of the classifier. For example, the nozzle in the classifier may comprise two slits on opposite sides of the nozzle from one another. Moreover, the nozzle itself may be in the form of an annulus or ring, with a slit continuously extending around the outer surface of the annular nozzle.

The present invention is also directed to a method of classifying particles as described herein.

BRIEF DESCRIPTION OF THE DRAWINGS

The present invention will be further explained by way of a detailed description with reference to the accompanying drawings, wherein:

FIG. 2(A) is a sectional view of one embodiment of the classifier according to the present invention;

FIG. 2(B) is a sectional view along line B—B of FIG. 2(A);

FIGS. 3(A) and 3(B) are schematic sectional views of types of gas flow through the classifier of FIGS. 2(A) and 2(B);

FIG. 4(A) is a sectional view of another embodiment of the classifier according to the present invention;

FIG. 4(B) is a sectional view along line B—B of FIG. 4(A);

DETAILED DESCRIPTION OF THE PREFERRED EMBODIMENTS

Figure 1:
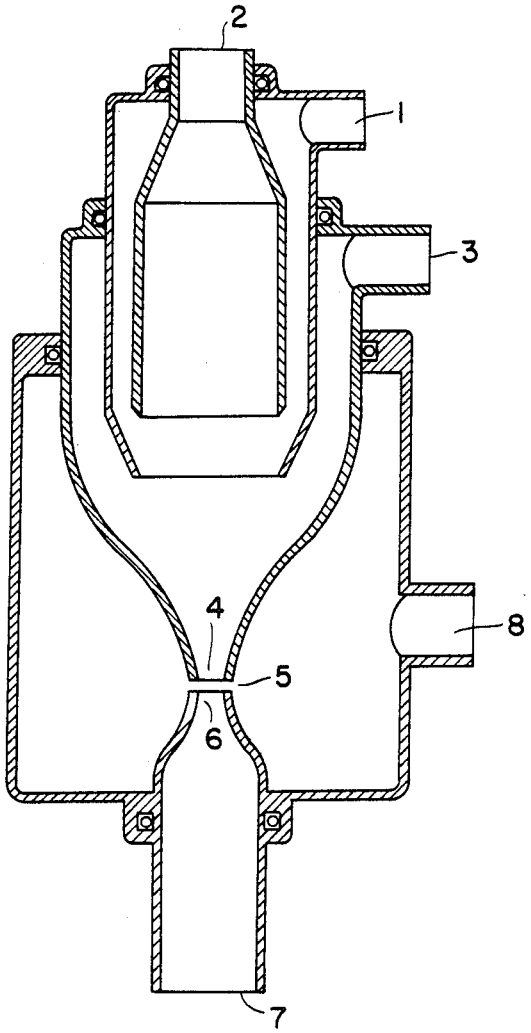
FIG. 1 is a sectional view of the classifier of Japanese Application No. 54-076092.

Referring to the embodiments of FIGS. 2(A) and 2(B), gas containing particles to be classified initially flows into the classifier of the present invention through inlet 9. Two clean gas streams enter the classifier through inlets 10 and 11 respectively. These three individual gas streams together form a three-phase gas flow through the curved member 12, and onto nozzle 13 of substantially rectangular cross-section, where the impact phenomenon occurs. The finer particles exit with gas flowing through slit 14 on one side of nozzle 13 and then through outlet 15, while the coarser particles remain in the gas that flows through nozzle 16 of substantially rectangular cross-section and then through oulet 17.

As illustrated in FIGS. 2(A) and 2(B), nozzles 13 and 16 are both rectangular in cross-section. For example, the dimensions of nozzles 13 and 16 for processing 4 kg./hr. of particles are both preferably 2 mm. width by 100 mm. length, with the width of slit 14 preferably 1 mm. These dimensions will result in a separation size of 0.5 micron to 2.0 microns for fine ceramic powder, depending on the alteration and flow rates of both clean gas streams as illustrated in FIGS. 3(A) and 3(B).

FIG. 3(A) illustrates the situation where the flow rates of the two clean gas streams 18 and 19 are substantially equal, so that the center of the three-phase flow is the gas stream 20 containing the particles to be classified. FIG. 3(B) illustrates the situation where the flow rate of clean gas stream 19 is greater than the flow rate of clean gas stream 18, so that the flow of the gas stream 20 containing the particles is far to the left of slit 14 in FIG. 3(B) as compared to FIG. 3(A). Therefore, the separation size of particles for classification in FIG. 3(B) is much smaller than the separation size for particles in FIG. 3(A). Thus, the separation size for classifying particles can be easily varied by simply altering the flow rates of the clean gas streams 18 and 19 respectively. In fact, the flow of clean gas streams 18 and/or 19 could be stopped altogether, if desired. This is one of the advantageous features of the present invention.

According to FIGS. 4(A) and 4(B), an additional outlet 22 and slit 21 can be added to the classifier of FIGS. 2(A) and 2(B) on the side of nozzle 13 opposite slit 14 and outlet 15. This particular embodiment can process and classify a great deal more particles at a faster rate than the embodiment of FIGS. 2(A) and 2(B), however, there is a greater likelihood of more coarser particles winding up in the finer particles separated out than with the embodiment of FIGS. 2(A) and 2(B).

Figure 5B:
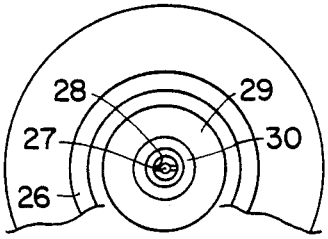
FIG. 5(B) is a sectional view along line B—B of FIG. 5(A)
Figure 5A:
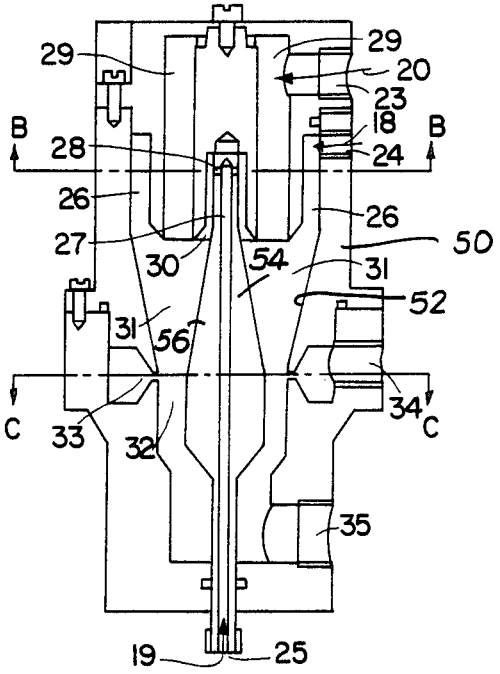
FIG. 5(A) is a sectional view of yet another embodiment of a classifier according to the present invention.
Figure 5C:
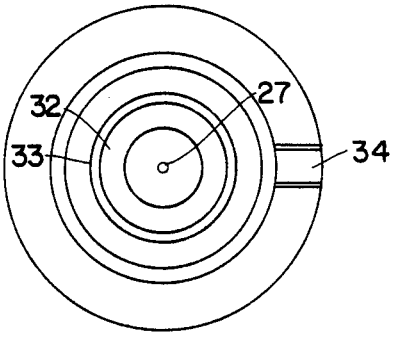
FIG. 5(C) is a sectional view along line C—C of FIG. 5(A).

FIGS. 5(A), 5(B) and 5(C) illustrate yet another embodiment of the present invention, a classifier utilizing a circular nozzle 32 of substantially annular cross-sectional shape, as best seen in FIG. 5(C), instead of the nozzle 13 of substantially rectangular cross-section as illustrated in FIGS. 2(A), 2(B), 3(A) and 3(B). As seen in FIG. 5(A) the classifier comprises an outer housing 50 having an inner wall 52 defining an interior space 31. A body member 54 is disposed in interior space 31 and has an outer wall 56. A nozzle 32 having an annular cross-section is defined between inner and outer walls 52 and 56. The gas stream 20 containing the particles to be classified is introduced into the classifier through inlet 23, while clean gas streams 18 and 19 are introduced into the classifier through inlets 24 and 25 respectively. Clean gas stream 19 flows into inlet 25, up through flow pass 27 formed in body number 54, then through holes 28, and into flow pass 30 as best seen in FIGS. 5(A) and 5(B). Clean gas stream 18 flows into flow pass 26 after passing through inlet 24, while gas stream 20 containing the particles flows into flow pass 29 after passing through inlet 23. All respective flow passes 30, 29 and 16 are concentrically disposed with respect to one another as best seen in FIG. 5(B). Then, these three gas streams 20, 18 and 19, which pass through respective flow passes 29, 26 and 30, flow together in curved, annular-shaped space 31 to form a three-phase gas flow substantially in the shape of annular rings.

The three-phase gas flow then passes into the nozzle 32 where the impact phenomenon causing classification occurs, with the finer particles exiting with the gas flowing through circular slit 33 and then through outlet 34. Circular slit 33 is disposed completely around the outer circumference of nozzle 32, as best seen in FIG. 5(C). The coarser particles remain in the gas flowing out through outlet 35. In the present embodiment, the three gas streams 20, 18 and 19 all have positive pressure to create a jet stream through slit 33. However, if it is desired to reduce the particle separation size, then it is possible to maintain the pressure at outlets 34 and 35 below the ambient pressure.

The gas flow containing the finer particles and the gas flow concerning the coarser particles are each passed to respective bag precipitators to separate the respective particles from the gas streams, thus obtaining quantities of finer and coarser particles. Another advantageous feature of the present invention is that virtually each component of the classifier can be prepared by simple lathes, thus considerably reducing manufacturing costs and expenses for such a classifier. Additionally, the classifier of the present invention illustrated in FIGS. 5(A), 5(B), and 5(C) may be provided with an additional outlet for finer particles on the side of nozzle 32 opposite outlet 34, to increase processing capacity, analogous to the embodiment of FIGS. 4(A) and 4(B) which increases the processing capacity of the embodiment of FIGS. 2(A) and 2(B). Moreover, a classifier not utilizing any clean gas streams can be prepared of similar construction to the above-described embodiments. Such a classifier would not have as sharp a particle separation ability, yet would be more simple and economical to construct.

The preceding description of the present invention is merely exemplary and is not intended to limit the scope thereof.

What is claimed is:

1. A particle classifier, adapted for multi-phase gas flow, comprising a nozzle substantially in the form of a narrowed throat, said throat being of substantially rectangular cross-section and through which a gas stream carrying particles to be classified is adapted to flow, said nozzle provided with an opening along one side of said substantially rectangular throat, finer particles exiting from the flowing stream through said opening, means for introducing the particle gas stream into said nozzle and comprising a first conduit disposed upstream of said nozzle, and means for introducing at least one other flowing gas stream into said nozzle and comprising a second conduit disposed upstream of said nozzle.

2. The classifier of claim 1 in which said opening in said nozzle is substantially in the form of a narrow slit along said one side of said substantially rectangular throat, said first conduit is disposed substantially in the direction of flow through said nozzle, and said second conduit is disposed substantially perpendicular to flow through said nozzle.

3. The classifier of claim 2 in which said nozzle comprises three sections, each substantially rectangular and cross-section, a first converging section narrowing in cross-section in the direction of gas flow, a second throat section constituting a narrowest point of said nozzle, and a third diverging section situated downstream of said second section and gradually expanding in cross-section in the direction of gas flow, with said slit located substantially at said throat.

4. The classifier of claim 2 additionally comprising a second narrow slit along a side of said throat opposite said first slit.

5. The classifier of claim 3 in which said means for introducing at least one other gas stream comprises a third conduit disposed upstream of said nozzle and in a direction substantially perpendicular to flow through said nozzle.

6. The classifier of claim 5, additionally comprising a fourth conduit for directing both the particle gas stream and the at least one other flowing gas stream to said nozzle, said fourth conduit communicating with said nozzle and with said first, second, and third conduits to receive the respective gas flows, said first conduit extending within said fourth conduit and terminating at a point upstream of said nozzle and downstream of said second and third conduits.

7. The classifier of claim 6, additionally comprising means for controlling fluid flow rate through said second and third conduits to thereby control size of particles passing through said opening in said nozzle.

8. A particle size classifier, adapted for multi-phase flow, comprising an outer housing having an inner wall defining an interior space;

a body member disposed in said interior space and having an outer wall, said inner wall of said outer housing and said outer wall of said body member defining a nozzle between them of substantially annular cross-section through which a gas stream carrying particles to be classified is adapted to flow, said nozzle being provided with an opening extending around at least a portion of said inner wall of said outer housing through which finer particles exit from the flowing gas stream, means for introducing the particle gas stream into said nozzle including a first conduit communicating with a region upstream of said nozzle, and means for introducing at least one other flowing gas stream into said nozzle including second conduit means communicating with a region upstream of said nozzle.

9. The classifier of claim 8, in which said second conduit means for introducing at least one other flowing gas stream comprises a passage extending through said body member, said passage provided with at least one outlet upstream of said nozzle.

10. The classifier of claim 9 in which said opening in said nozzle is substantially in the form of a narrow slit extending substantially around the entire circumference of said inner wall of said outer housing.

11. The classifier of claim 10 in which said second conduit means for introducing at least one other gas stream further comprises a second conduit disposed upstream of said nozzle.

12. A method of classifying particles which comprises the steps of directing a flowing gas stream carrying the particles through a nozzle in the form of a narrowed throat of substantially rectangular cross-section which is provided with an opening along one side thereof through which finer particles exit from the flowing stream, directing a first substantially particle-free, flowing gas stream into the nozzle along with the particle gas stream, and controlling flow rate of the first gas stream to thereby control size of particles passing through the opening in the nozzle.

13. The method of claim 12 which comprises the additional steps of directing a second substantially particle-free, flowing gas stream into the nozzle on a side of the particle gas stream opposite the first gas stream, and adjusting flow rates of both the first and second substantially particle-free gas streams.

14. A method of classifying particles in a classifier including an outer housing having an inner wall defining an interior space, a body member disposed in said interior space and having an outer wall, said inner wall of said outer housing and said outer wall of said body member defining a nozzle between them of substantially annular cross-section, the nozzle being provided with an opening extending around at least a portion of said inner wall of said outer housing, comprising the steps of directing a flowing gas stream carrying the particles into said interior space between the interior wall of said outer housing and the wall of said body member through the nozzle of substantially annular cross-section which is provided with an opening extending around at least a portion of an outer circumference thereof through which finer particles exit from the flowing gas stream, an inner circumference of the nozzle remaining closed, directing a first substantially particle-free, flowing gas stream upstream of the nozzle and flowing gas stream along with the particle gas stream into the nozzle, and controlling the flow rate of the first gas stream to thereby control size of particles passing through the opening in the nozzle.

15. The method of claim 14 which comprises the additional steps of directing a second substantially particle-free, flowing gas stream into the nozzle on a side of the particle gas stream opposite the first gas stream, directing one of the first and second substantially particle-free gas streams through a passage formed in the body member and to the side of the particle gas stream opposite the other of the first and second substantially particle-free gas streams, and adjusting flow rates of both the first and second substantially particle-free gas streams.

* * * * *